US009583114B2

(12) United States Patent
Lombard et al.

(10) Patent No.: US 9,583,114 B2
(45) Date of Patent: Feb. 28, 2017

(54) GENERATION OF A COMFORT NOISE WITH HIGH SPECTRO-TEMPORAL RESOLUTION IN DISCONTINUOUS TRANSMISSION OF AUDIO SIGNALS

(71) Applicant: Fraunhofer-Gesellschaft zur Foerderung der angewandten Forschung e.V., Munich (DE)

(72) Inventors: Anthony Lombard, Erlangen (DE); Martin Dietz, Nuremberg (DE); Stephan Wilde, Nuremberg (DE); Emmanuel Ravelli, Erlangen (DE); Panji Setiawan, Erlangen (DE); Markus Multrus, Nuremberg (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 14/744,715

(22) Filed: Jun. 19, 2015

(65) Prior Publication Data

US 2015/0287415 A1 Oct. 8, 2015

Related U.S. Application Data

(63) Continuation of application No. PCT/EP2013/077525, filed on Dec. 19, 2013.
(Continued)

(51) Int. Cl.
*G10L 19/002* (2013.01)
*G10L 19/012* (2013.01)
*G10L 19/24* (2013.01)

(52) U.S. Cl.
CPC ..... *G10L 19/012* (2013.01); *G10L 19/002* (2013.01); *G10L 19/24* (2013.01)

(58) Field of Classification Search
CPC ..... G10L 19/012; G10L 19/02; G10L 19/24
(Continued)

(56) References Cited

U.S. PATENT DOCUMENTS 5,537,509 A * 7/1996 Swaminathan ..... G10L 19/012 704/214
5,630,016 A * 5/1997 Swaminathan ..... G10L 19/012 704/214
(Continued)

FOREIGN PATENT DOCUMENTS

EP 665530 B1 8/2000
EP 1154408 A2 11/2001
(Continued)

OTHER PUBLICATIONS

Benyassine, Adit, et al. "ITU-T Recommendation G. 729 Annex B: a silence compression scheme for use with G. 729 optimized for V. 70 digital simultaneous voice and data applications." Communications Magazine, IEEE 35.9, Sep. 1997, pp. 64-73.*
(Continued)

*Primary Examiner* — James Wozniak
(74) *Attorney, Agent, or Firm* — Perkins Coie LLP; Michael A. Glenn

(57) ABSTRACT

The invention provides an audio decoder being configured for decoding a bitstream so as to produce therefrom an audio output signal, the bitstream including at least an active phase followed by at least an inactive phase, wherein the bitstream has encoded therein at least a silence insertion descriptor frame which describes a spectrum of a background noise, the audio decoder including: a silence insertion descriptor decoder configured to decode the silence insertion descriptor frame; a decoding device configured to reconstruct the audio output signal from the bitstream during the active phase; a spectral converter configured to determine a spectrum of the audio output signal; a noise estimator device configured to
(Continued)

determine a first spectrum of the noise of the audio output signal; a resolution converter configured to establish a second spectrum of the noise of the audio output signal; a comfort noise spectrum estimation device; and a comfort noise generator.

19 Claims, 5 Drawing Sheets

Related U.S. Application Data

(60) Provisional application No. 61/740,857, filed on Dec. 21, 2012.

(58) Field of Classification Search
USPC ..... 704/205, 210, 220, 228
See application file for complete search history.

(56) References Cited

U.S. PATENT DOCUMENTS

| | | | | |
|---|---|---|---|---|
| 5,991,716 | A * | 11/1999 | Lehtimaki | G10L 19/16 704/212 |
| 6,615,169 | B1 * | 9/2003 | Ojala | G10L 19/012 704/205 |
| 6,873,604 | B1 * | 3/2005 | Surazski | G10L 19/012 370/271 |
| 7,203,638 | B2 | 4/2007 | Jelinek et al. | |
| 7,454,010 | B1 * | 11/2008 | Ebenezer | G10L 21/0208 379/392.01 |
| 2005/0278171 | A1 * | 12/2005 | Suppappola | G10L 19/012 704/227 |
| 2007/0050189 | A1 | 3/2007 | Cruz-Zeno et al. | |
| 2007/0110042 | A1 * | 5/2007 | Li | G10L 25/78 370/352 |
| 2009/0110209 | A1 * | 4/2009 | Li | H04R 3/04 381/73.1 |
| 2009/0222268 | A1 * | 9/2009 | Li | G10L 13/04 704/261 |
| 2010/0198590 | A1 * | 8/2010 | Tackin | G10L 25/90 704/214 |
| 2010/0318352 | A1 * | 12/2010 | Taddei | G10L 19/012 704/226 |
| 2010/0324917 | A1 | 12/2010 | Shlomot et al. | |
| 2012/0237048 | A1 | 9/2012 | Barron et al. | |
| 2013/0304464 | A1 | 11/2013 | Wang et al. | |
| 2013/0332176 | A1 * | 12/2013 | Setiawan | G10L 19/012 704/500 |
| 2014/0376744 | A1 | 12/2014 | Hetherington | |
| 2015/0243299 | A1 | 8/2015 | Sehlstedt | |

FOREIGN PATENT DOCUMENTS

| | | | |
|---|---|---|---|
| EP | 1229520 | A2 | 8/2002 |
| EP | 1224659 | B1 | 5/2005 |
| EP | 1998319 | B1 | 8/2010 |
| JP | H11205485 | A | 7/1999 |
| JP | 2003522964 | A | 7/2003 |
| JP | 2005114890 | A | 4/2005 |
| JP | 2007065636 | A | 3/2007 |
| JP | 2011516901 | A | 5/2011 |
| KR | 1020050049538 | A | 5/2005 |
| KR | 1020080042153 | A | 5/2008 |
| RU | 2237296 | C2 | 9/2004 |
| RU | 2325707 | C2 | 5/2008 |
| RU | 2461898 | C2 | 9/2012 |
| WO | 9957715 | A1 | 11/1999 |
| WO | 02101724 | | 12/2002 |
| WO | 2006136901 | A2 | 12/2006 |
| WO | 2009097020 | A1 | 8/2009 |
| WO | 2010003618 | A2 | 1/2010 |
| WO | 2010040522 | A2 | 4/2010 |
| WO | 2010148516 | A1 | 12/2010 |
| WO | 2011049515 | A1 | 4/2011 |
| WO | 2012055016 | A1 | 5/2012 |
| WO | 2012110482 | A2 | 8/2012 |
| WO | 2014096279 | A1 | 6/2014 |

OTHER PUBLICATIONS

Lombard, Anthony, et al. "Frequency-domain Comfort Noise Generation for Discontinuous Transmission in EVS." Acoustics, Speech and Signal Processing (ICASSP), 2015 IEEE International Conference on. IEEE, Apr. 2015, pp. 5893-5897.*

"Adaptive Multi-Rate wideband speech transcoding", 3GPP TS 26.190; 3GPP Technical Specification.

"Frame error robust narrow-band and wideband embedded variable bit-rate coding of speech and audio from 8-32 kbit/s", Recommendation ITU-T G.718.

* cited by examiner

GENERATION OF A COMFORT NOISE WITH HIGH SPECTRO-TEMPORAL RESOLUTION IN DISCONTINUOUS TRANSMISSION OF AUDIO SIGNALS

CROSS-REFERENCE TO RELATED APPLICATIONS

This application is a continuation of copending International Application No. PCT/EP2013/077525, filed Dec. 19, 2013, which is incorporated herein by reference in its entirety, and additionally claims priority from U.S. Application No. 61/740,857, filed Dec. 21, 2012, which is also incorporated herein by reference in its entirety.

BACKGROUND OF THE INVENTION

The present invention relates to audio signal processing, and, in particular, to comfort noise addition to audio signals.

Comfort noise generators are usually used in discontinuous transmission (DTX) of audio signals, in particular of audio signals containing speech. In such a mode the audio signal is first classified in active and inactive frames by a voice activity detector (VAD). Based on the VAD result, only the active speech frames are coded and transmitted at the nominal bit-rate. During long pauses, where only the background noise is present, the bit-rate is lowered or zeroed and the background noise is coded episodically and parametrically using silence insertion descriptor frames (SID frames). The average bit-rate is then significantly reduced.

The noise is generated during the inactive frames at the decoder side by a comfort noise generator (CNG). The size of an SID frame is very limited in practice. Therefore, the number of parameters describing the background noise has to be kept as small as possible. To this aim, the noise estimation is not applied directly in the output of the spectral transforms. Instead, it is applied at a lower spectral resolution by averaging the input power spectrum among groups of bands, e.g., following the Bark scale. The averaging can be achieved either by arithmetic or geometric means. Unfortunately, the limited number of parameters transmitted in the SID frames does not allow to capture the fine spectral structure of the background noise. Hence only the smooth spectral envelope of the noise can be reproduced by the CNG. When the VAD triggers a CNG frame, the discrepancy between the smooth spectrum of the reconstructed comfort noise and the spectrum of the actual background noise can become very audible at the transitions between active frames (involving regular coding and decoding of a noisy speech portion of the signal) and CNG frames.

SUMMARY

According to a first embodiment, an audio decoder for decoding a bitstream so as to produce therefrom an audio output signal, the bitstream including at least an active phase followed by at least an inactive phase, wherein the bitstream has encoded therein at least a silence insertion descriptor frame which describes a spectrum of a background noise, may have: a silence insertion descriptor decoder configured to decode the silence insertion descriptor frame so as to reconstruct the spectrum of the background noise; a decoding device configured to reconstruct the audio output signal from the bitstream during the active phase; a spectral converter configured to determine a spectrum of the audio output signal; a noise estimator device configured to determine a first spectrum of the noise of the audio output signal based on the spectrum of the audio output signal provided by the spectral converter, wherein the first spectrum of the noise of the audio output signal has a higher spectral resolution than the spectrum of the background noise; a resolution converter configured to establish a second spectrum of the noise of the audio output signal based on the first spectrum of the noise of the audio output signal, wherein the second spectrum of the noise of the audio output signal has a same spectral resolution as the spectrum of the background noise; a comfort noise spectrum estimation device having a scaling factor computing device configured to compute scaling factors for a spectrum for a comfort noise based on the spectrum of the background noise as provided by the silence insertion descriptor decoder and based on the second spectrum of the noise of the audio output signal as provided by the resolution converter and having a comfort noise spectrum generator configured to compute the spectrum for a comfort noise based on the scaling factors; and a comfort noise generator configured to produce the comfort noise during the inactive phase based on the spectrum for the comfort noise.

Another embodiment may have a system including a decoder and an encoder, wherein the decoder is designed according to the above-mentioned decoder.

According to another embodiment, a method of decoding an audio bitstream so as to produce therefrom an audio output signal, the bitstream including at least an active phase followed by at least an inactive phase, wherein the bitstream has encoded therein at least a silence insertion descriptor frame which describes a spectrum of a background noise, may have the steps of: decoding the silence insertion descriptor frame so as to reconstruct the spectrum of the background noise; reconstructing the audio output signal from the bitstream during the active phase; determining a spectrum of the audio output signal; determining a first spectrum of the noise of the audio output signal based on the spectrum of the audio output signal, wherein the first spectrum of the noise of the audio output signal has a higher spectral resolution than the spectrum of the background noise; establishing a second spectrum of the noise of the audio output signal based on the first spectrum of the noise of the audio output signal, wherein the second spectrum of the noise of the audio output signal has a same spectral resolution as the spectrum of the background noise; computing scaling factors for a spectrum for a comfort noise based on the spectrum of the background noise and based on the second spectrum of the noise of the audio output signal; and producing the comfort noise during the inactive phase based on the spectrum for the comfort noise.

Another embodiment may have a computer program for performing, when running on a computer or a processor, the inventive method.

In one aspect the invention provides an audio decoder being configured for decoding a bitstream so as to produce therefrom an audio output signal, the bitstream comprising at least an active phase followed by at least an inactive phase, wherein the bitstream has encoded therein at least a silence insertion descriptor frame which describes a spectrum of a background noise, the audio decoder comprising:

a silence insertion descriptor decoder configured to decode the silence insertion descriptor frame so as to reconstruct a spectrum of the background noise;

a decoding device configured to reconstruct the audio output signal from the bitstream during the active phase;

a spectral converter configured to determine a spectrum of the audio output signal;

a noise estimator device configured to determine a first spectrum of the noise of the audio output signal based on the spectrum of the audio output signal provided by the spectral converter, wherein the first spectrum of the noise of the audio output signal has a higher spectral resolution than the spectrum of the background noise as provided by the silence insertion descriptor decoder;

a resolution converter configured to establish a second spectrum of the noise of the audio output signal based on the first spectrum of the noise of the audio output signal, wherein the second spectrum of the noise of the audio output signal has a same spectral resolution as the spectrum of the background noise as provided by the silence insertion descriptor decoder;

a comfort noise spectrum estimation device having a scaling factor computing device configured to compute scaling factors for a spectrum for a comfort noise based on the spectrum of the background noise as provided by the silence insertion descriptor decoder and based on the second spectrum of the noise of the audio output signal as provided by the resolution converter and having a comfort noise spectrum generator configured to compute the spectrum for a comfort noise based on the scaling factors; and a comfort noise generator configured to produce the comfort noise during the inactive phase based on the spectrum for the comfort noise.

The bitstream contains active phases and inactive phases, wherein an active phase is a phase, which contains wanted components of the audio information, such as speech or music, whereas an inactive phase is a phase, which does not contain any wanted components of the audio information. Inactive phases usually occur during pauses, where no wanted components, such as music or speech, are present. Therefore, inactive phases usually contain solely background noise. The information in the bitstream containing an encoded audio signal is embedded in so called frames, wherein each of these frames contain audio information referring to a certain time. During active phases active frames comprising audio information including audio information regarding the wanted signal may be transmitted within the bitstream. In contrast of that, during inactive phases silence insertion descriptor frames comprising noise information may be transmitted within the bitstream at a lower average bit-rate compared to the average bit-rate of the active phases.

The silence insertion descriptor decoder is configured to decode the silence insertion descriptor frames so as to reconstruct a spectrum of the background noise. However, this spectrum of the background noise does not allow to capture the fine spectral structure of the background noise due to a limited number of parameters transmitted in the silence insertion descriptor frames.

The decoding device may be a device or a computer program capable of decoding the audio bitstream, which is a digital data stream containing audio information, during active phases. The decoding process may result in a digital decoded audio output signal, which may be fed to a D/A converter to produce an analogous audio signal, which then may be fed to a loudspeaker, in order to produce an audible signal.

The spectral converter may obtain a spectrum of the audio output signal which has a significantly higher spectral resolution than the spectrum of the background noise as provided by the silence insertion descriptor decoder.

Therefore, the noise estimator may determine a first spectrum of the noise of the audio output signal based on the spectrum of the audio output signal provided by the spectral converter, wherein the first spectrum of the noise of the audio output signal has a higher spectral resolution than the spectrum of the background noise as provided by the silence insertion descriptor decoder.

Further, the resolution converter may establish a second spectrum of the noise of the audio output signal based on the first spectrum of the noise of the audio output signal, wherein the second spectrum of the noise of the audio output signal has a same spectral resolution as the spectrum of the background noise as provided by the silence insertion descriptor decoder.

The scaling factor computing device may easily compute scaling factors for a spectrum for a comfort noise based on the spectrum of the background noise as provided by the silence insertion descriptor decoder and based on the second spectrum of the noise of the audio output signal as provided by the resolution converter as the spectrum of the background noise as provided by the silence insertion descriptor decoder and the second spectrum of the noise of the audio output signal have the same spectral resolution.

The comfort noise spectrum generator may establish the spectrum for the comfort noise based on the scaling factors and based on the first spectrum of the noise of the audio output signal as provided by the noise estimation device.

Furthermore, the comfort noise generator may produce the comfort noise during the inactive phase based on the spectrum for the comfort noise.

The noise estimates obtained at the decoder contain information about the spectral structure of the background noise, which is more accurate than the information about the smooth spectral envelope of the background noise contained in the SID frames. However, these estimates cannot be updated during inactive phases since the noise estimation is carried out on the decoded audio output signal during active phases. In contrast, the SID frames deliver new information about the spectral envelope during inactive phases. The decoder according to the invention combines these two sources of information. The scaling factors may be updated during active phases depending on the noise estimates at the decoder side and during inactive phases depending on the noise estimates contained in the SID frames. The continuous update of the scaling factors ensures that there are no sudden changes of the characteristics of the produced comfort noise.

As the spectrum of the background noise as contained in the SID frames and the second spectrum of the noise of the audio output signal have the same spectral resolution the update of the scaling factors and, hence, of the comfort noise can be done in an easy way, as for each frequency band group of the spectrum of the background noise as contained in the SID frames exactly one frequency band group exists in the second spectrum of the noise of the audio output signal. It has to be noted that in an embodiment the frequency band groups of the spectrum of the background noise as contained in the SID frames and the frequency band groups of the second spectrum of the noise of the audio output signal correspond to each other.

Further, as the spectrum of the background noise as contained in the SID frames and the second spectrum of the noise of the audio output signal have the same spectral resolution the update of the scaling factors produces no or only barely audible artifacts.

According to an embodiment of the invention the spectral analyzer comprises a fast Fourier transformation device. A fast Fourier transform (FFT) is an algorithm to compute a discrete Fourier transform (DFT) and it's inverse, which necessitates only low computational effort. Therefore, the fast Fourier transformation device may calculate the spectrum of the audio output signal in an easy way.

According to an embodiment of the invention the noise estimator device at the decoder comprises a converter device configured to convert the spectrum of the audio output signal into a converted spectrum of the audio output signal which has in general a much lower spectral resolution. By providing the converted spectrum of the audio output signal the complexity of subsequent computational steps may be reduced.

According to an embodiment of the invention the noise estimator device comprises a noise estimator configured to determine the first spectrum of the noise of the audio output signal based on the converted spectrum of the audio output signal provided by the converter device. When the converted spectrum of the audio output signal is used as a basis for the noise estimation at the decoder computational efforts may be reduced without lowering the quality of the noise estimation.

According to an embodiment of the invention the scaling factor computing device is configured to compute the scaling factors according to the formula $$\hat{S}^{LR}(i) = \frac{\hat{N}_{SID}^{LR}(i)}{\hat{N}_{dec}^{LR}(i)},$$

wherein $\hat{S}^{FR}(i)$ denotes a scaling factor for a frequency band group i of the comfort noise, wherein $\hat{N}_{SID}^{LR}(i)$ denotes a level of a frequency band group i of the spectrum of the background noise as contained in the SID frames, wherein $\hat{N}_{dec}^{LR}(i)$ denotes a level of a frequency band group i of the second spectrum of the noise of the audio output signal, wherein $i=0, \ldots, L^{LR}-1$, wherein $L^{LR}$ is the number of frequency band groups of the spectrum of the background noise as contained in the SID frames and of the second spectrum of the noise of the audio output signal. By these features the scaling factors may be computed in an easy manner.

According to an embodiment of the invention the comfort noise spectrum generator is configured to compute the spectrum of the comfort noise based on the scaling factors and based on the first spectrum of the noise of the audio output signal as provided by the noise estimation device. By these features the comfort noise spectrum may be computed in such way that it has the spectral resolution of the first spectrum of the noise of the audio output signal, which is in general much higher than the spectral resolution obtained from SID frames.

According to an embodiment of the invention the comfort noise spectrum generator is configured to compute the spectrum of the comfort noise according to the formula $\hat{N}^{FR}(k)=\hat{S}^{LR}(i)\cdot\hat{N}_{dec}^{HR}(k)$, wherein $\hat{N}^{FR}(k)$ denotes a level of a frequency band k of the spectrum of the comfort noise, wherein $\hat{S}^{LR}(i)$ denotes a scaling factor of a frequency band group i of the spectrum of the background noise as contained in the SID frames and of the second spectrum of the noise of the audio output signal, wherein $\hat{N}_{dec}^{HR}(k)$ denotes a level of a frequency band k of the first spectrum of the noise of the audio output signal, wherein $k=b^{LR}(i), \ldots, b^{LR}(i+1)-1$, wherein $b^{LR}(i)$ is a first frequency band of one of the frequency band groups, wherein $i=0, \ldots, L^{LR}-1$, wherein $L^{LR}$ is the number of frequency band groups of the spectrum of the background noise as contained in the SID frames and of the second spectrum of the noise of the audio output signal. By these features the spectrum of the comfort noise may be computed at the high-resolution in an easy way.

According to an embodiment of the invention the resolution converter comprises a first converter stage configured to establish a third spectrum of the noise of the audio output signal based on the first spectrum of the noise of the audio output signal, wherein the spectral resolution of the third spectrum of the noise of the audio output signal is higher or the same as the spectral resolution of the first spectrum of the noise of the audio output signal, and wherein the resolution converter comprises a second converter stage configured to establish the second spectrum of the noise of the audio output signal.

According to an embodiment of the invention the comfort noise spectrum generator is configured to compute the spectrum of the comfort noise based on the scaling factors and based on the third spectrum of the noise of the audio output signal as provided by the first converter stage of the resolution converter. By these features a comfort noise spectrum may be obtained during inactive phases which has a higher spectral resolution than spectral resolution of the first spectrum of the noise of the audio output signal during active phases.

According to an embodiment of the invention the comfort noise spectrum generator is configured to compute the spectrum of the comfort noise according to the formula $\hat{N}^{FR}(k)=\hat{S}^{LR}(i)\cdot\hat{N}_{dec}^{FR}(k)$, wherein $\hat{N}^{FR}(k)$ denotes a level of a frequency band k of the spectrum of the comfort noise, wherein $\hat{S}^{LR}(i)$ denotes a scaling factor of a frequency band group i of the spectrum of the background noise as contained in the SID frames and of the second spectrum of the noise of the audio output signal, wherein $\hat{N}_{dec}^{FR}(k)$ denotes a level of a frequency band k of the third spectrum of the noise of the audio output signal, wherein $k=b^{LR}(i), \ldots, b^{LR}(i+1)-1$, wherein $b^{LR}(i)$ is a first frequency band of a frequency band group, wherein $i=0, \ldots, L^{LR}-1$, wherein $L^{LR}$ is the number of frequency band groups of the spectrum of the background noise as contained in the SID frames and of the second spectrum of the noise of the audio output signal. By these features the spectrum of the comfort noise may be computed at the high-resolution in an easy way.

According to an embodiment of the invention the comfort noise generator comprises a first fast Fourier converter configured to adjust levels of frequency bands of the comfort noise in a fast Fourier transformation domain and a second fast Fourier converter to produce at least a part of the comfort noise based on an output of the first fast Fourier converter. By these features the background noise can be produced in an easy way.

According to an embodiment of the invention the decoding device comprises a core decoder configured to produce the audio output signal during the active phase. By these features a simple structure of the decoder may be achieved which is suitable for narrowband (NB) and wideband (WB) applications.

According to an embodiment of the invention the decoding device comprises a core decoder configured to produce an audio signal and a bandwidth extension module configured to produce the audio output signal based on the audio signal as provided by the core decoder. By these features a simple structure of the decoder may be achieved which is suitable for super wideband (SWB) applications.

According to an embodiment of the invention the bandwidth extension module comprises a spectral band replication decoder, a quadrature mirror filter analyzer, and/or a quadrature mirror filter synthesizer.

According to an embodiment of the invention the comfort noise as provided by the fast Fourier converter is fed to the bandwidth extension module. By this feature the comfort noise as provided by the fast Fourier converter may be transformed into a comfort noise with a higher bandwidth.

According to an embodiment of the invention the comfort noise generator comprises a quadrature mirror filter adjuster device configured to adjust levels of frequency bands of the comfort noise in a quadrature mirror filter domain, wherein an output of the quadrature mirror filter synthesizer is fed to the bandwidth extension module. By these features noise information transmitted by the silence insertion descriptor frames related to noise frequencies above the bandwidth of the core decoder may be used to further improve the comfort noise.

In a further aspect the invention relates to a system comprising a decoder and an encoder, wherein the decoder is designed according to the invention.

In another aspect the invention relates to a method of decoding an audio bitstream so as to produce therefrom an audio output signal, the bitstream comprising at least an active phase followed by at least an inactive phase, wherein the bitstream has encoded therein at least a silence insertion descriptor frame which describes a spectrum of a background noise, the method comprising the steps:

decoding the silence insertion descriptor frame so as to reconstruct a spectrum of the background noise;

reconstructing the audio output signal from the bitstream during the active phase;

determining a spectrum of the audio output signal;

determining a first spectrum of the noise of the audio output signal based on the spectrum of the audio output signal, wherein the first spectrum of the noise of the audio output signal has a higher spectral resolution than the spectrum of the background noise as provided by the silence insertion descriptor decoder;

establishing a second spectrum of the noise of the audio output signal based on the first spectrum of the noise of the audio output signal, wherein the second spectrum of the noise of the audio output signal has the same spectral resolution as the spectrum of the background noise as provided by the silence insertion descriptor decoder;

computing scaling factors for a spectrum for a comfort noise based on the spectrum of the background noise as provided by the silence insertion descriptor decoder and based on the second spectrum of the noise of the audio output signal; and producing the comfort noise during the inactive phase based on the spectrum for the comfort noise.

In a further aspect the invention relates to a computer program for performing, when running on a computer or a processor, the inventive method.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
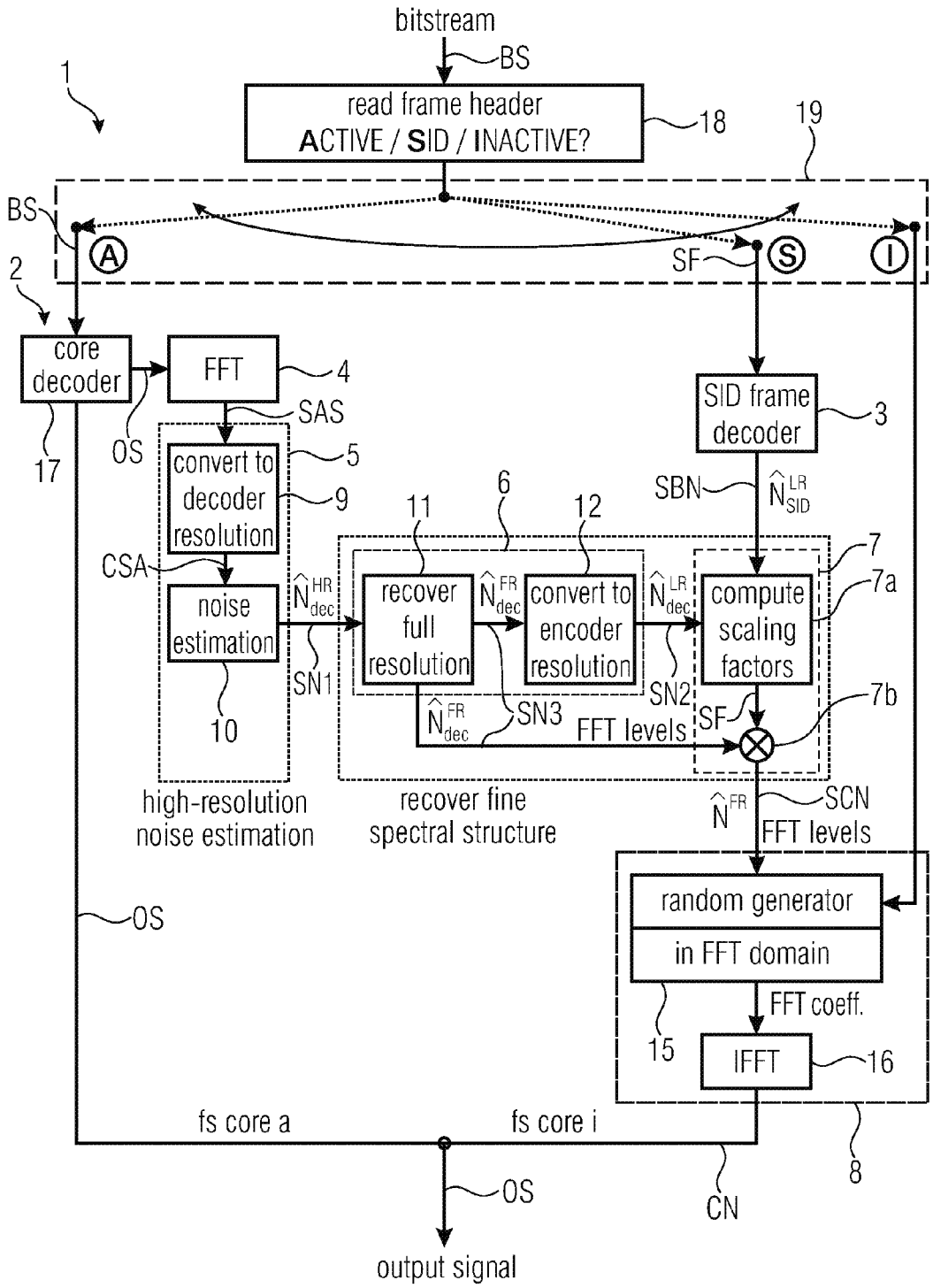
FIG. 1 illustrates a first embodiment of a decoder according to the invention.

FIG. 1 illustrates a first embodiment of a decoder 1 according to the invention. The audio decoder 1 depicted in FIG. 1 is configured for decoding a bitstream BS so as to produce therefrom an audio output signal OS, the bitstream BS comprising at least an active phase followed by at least an inactive phase, wherein the bitstream BS has encoded therein at least a silence insertion descriptor frame SI which describes a spectrum SBN of a background noise, the audio decoder 1 comprising:

a decoding device 2 configured to reconstruct the audio output signal OS from the bitstream BS during the active phase;

a silence insertion descriptor decoder 3 configured to decode the silence insertion descriptor frame SI so as to reconstruct the spectrum SBN of the background noise;

a spectral converter 4 configured to determine a spectrum SAS of the audio output signal OS;

a noise estimator device 5 configured to determine a first spectrum SN1 of the noise of the audio output signal OS based on the spectrum SAS of the audio output signal AS provided by the spectral converter 4, wherein the first spectrum SN1 of the noise of the audio output signal OS has a higher spectral resolution than the spectrum SBN of the background noise;

a resolution converter 6 configured to establish a second spectrum SN2 of the noise of the audio output signal OS based on the first spectrum SN1 of the noise of the audio output signal OS, wherein the second spectrum SN2 of the noise of the audio output signal OS has a same spectral resolution as the spectrum SBN of the background noise;

a comfort noise spectrum estimation device 7 having a scaling factor computing device 7*a* configured to compute scaling factors SF for a spectrum SCN for a comfort noise CN based on the spectrum SBN of the background noise as provided by the silence insertion descriptor decoder 3 and based on the second spectrum SN2 of the noise of the audio output signal OS as provided by the resolution converter 6 and having a comfort noise spectrum generator 7*b* configured to compute the spectrum SCN for a comfort noise CN based on the scaling factors SF; and a comfort noise generator 8 configured to produce the comfort noise CN during the inactive phase based on the spectrum SCN for the comfort noise CN.

The bitstream BS contains active phases and inactive phases, wherein an active phase is a phase, which contains wanted components of the audio information, such as speech or music, whereas an inactive phase is a phase, which does not contain any wanted components of the audio information. Inactive phases usually occur during pauses, where no wanted components, such as music or speech, are present. Therefore, inactive phases usually contain solely background noise. The information in the bitstream BS containing an encoded audio signal is embedded in so called frames, wherein each of these frames contain audio information referring to a certain time. During active phases active frames comprising audio information including audio information regarding the wanted signal may be transmitted within the bitstream BS. In contrast of that, during inactive phases silence insertion descriptor frames SI comprising noise information may be transmitted within the bitstream at a lower average bit-rate compared to the average bit-rate of the active phases.

The decoding device 2 may be a device or a computer program capable of decoding the audio bitstream BS, which is a digital data stream containing audio information, during active phases. The decoding process may result in a digital decoded audio output signal OS, which may be fed to a D/A converter to produce an analogous audio signal, which then may be fed to a loudspeaker, in order to produce an audible signal.

The silence insertion descriptor decoder 3 is configured to decode the silence insertion descriptor frames SI so as to reconstruct a spectrum SBN of the background noise. However, this spectrum SBN of the background noise does not allow to capture the fine spectral structure of the background noise due to a limited number of parameters transmitted in the silence insertion descriptor frames SI.

The spectral converter 4 may obtain a spectrum SAS of the audio output signal OS which has a significantly higher spectral resolution than the spectrum SBN of the background noise as provided by the silence insertion descriptor decoder 3.

Therefore, the noise estimator 10 may determine a first spectrum SN1 of the noise of the audio output signal OS based on the spectrum SAS of the audio output signal OS provided by the spectral converter 4, wherein the first spectrum SN1 of the noise of the audio output signal OS has a higher spectral resolution than the spectrum of the background noise SBN.

Further, the resolution converter 6 may establish a second spectrum SN2 of the noise of the audio output signal OS based on the first spectrum SN1 of the noise of the audio output signal OS, wherein the second spectrum SN2 of the noise of the audio output signal OS has a same spectral resolution as the spectrum of the background noise SBN.

The scaling factor computing device 7*a* may easily compute scaling factors SF for a spectrum SCN for a comfort noise CN based on the spectrum SBN of the background noise as provided by the silence insertion descriptor decoder 3 and based on the second spectrum SN2 of the noise of the audio output signal OS as provided by the resolution converter 6 as the spectrum SBN of the background noise and the second spectrum SN2 of the noise of the audio output signal OS have the same spectral resolution.

The comfort noise spectrum generator 7*b* may establish the spectrum SCN for the comfort noise CN based on the scaling factors SF.

Furthermore, the comfort noise generator 8 may produce the comfort noise CN during the inactive phase based on the spectrum SCN for the comfort noise.

The noise estimates obtained at the decoder 1 contain information about the spectral structure of the background noise, which is more accurate than the information about the spectral structure of the background noise contained in the SID frames SI. However, these estimates cannot be adapted during inactive phases since the noise estimation is carried out on the decoded audio output signal OS. In contrast, the SID frames deliver new information about the spectral envelope at regular intervals during inactive phases. The decoder 1 according to the invention combines these two sources of information. The scaling factors SF may be updated during active phases depending on the noise estimates at the decoder side and during inactive phases depending on the noise estimates contained in the SID frames SI. The continuous update of the scaling factors SF ensures that there are no sudden changes of the characteristics of the produced comfort noise CN.

As the spectrum SBN of the background noise as contained in the SID frames SI and the second spectrum SN2 of the noise of the audio output signal OS have the same spectral resolution the update of the scaling factors SF and, hence, of the comfort noise CN can be done in an easy way, as for each frequency band group of the spectrum SBN of the background noise as contained in the SID frames SI exactly one frequency band group exists in the second spectrum SN2 of the noise of the audio output signal OS. It has to be noted that in an embodiment the frequency band groups of the spectrum of the background noise as contained in the SID frames SI and the frequency band groups of the second spectrum SN2 of the noise of the audio output signal OS correspond to each other.

Further, as the spectrum SBN of the background noise as contained in the SID frames SI and the second spectrum SN2 of the noise of the audio output signal OS have the same spectral resolution the update of the scaling factors SF produces no or only barely audible artifacts.

According to an embodiment of the invention the spectral analyzer 4 comprises a fast Fourier transformation device. A fast Fourier transform (FFT) is an algorithm to compute a discrete Fourier transform (DFT) and it's inverse, which necessitates only low computational effort. Therefore, the fast Fourier transformation device may calculate the spectrum SAS of the audio output signal OS in an easy way.

According to an embodiment of the invention the noise estimator device 5 comprises a converter device 9 configured to convert the spectrum SAS of the audio output signal OS into a converted spectrum CSA of the audio output signal OS which has the same spectral resolution as the core decoder 17. In general the spectral resolution of the spectrum SAS of the audio output signal OS obtained by a spectral converter 4 is much higher than the spectral resolution of the core decoder 17. By providing the converted spectrum CSA of the audio output signal OS the complexity of subsequent computational steps may be reduced.

According to an embodiment of the invention the noise estimator device 5 comprises a noise estimator 10 configured to determine the first spectrum SN1 of the noise of the audio output signal OS based on the converted spectrum CAS of the audio output signal OS provided by the converter device 9. When the converted spectrum CSA of the audio output signal OS is used as a basis for the noise estimation at the decoder computational efforts may be reduced without lowering the quality of the noise estimation.

According to an embodiment of the invention the scaling factor computing device 7*a* is configured to compute the scaling factors SF according to the formula $$\hat{S}^{LR}(i) = \frac{\hat{N}_{SID}^{LR}(i)}{\hat{N}_{dec}^{LR}(i)},$$

wherein $\hat{S}^{FR}(i)$ denotes a scaling factor SF for a frequency band group i of the comfort noise CN, wherein $\hat{N}_{SID}{}^{LR}(i)$ denotes a level of a frequency band group i of the spectrum SBN of the background noise, wherein $\hat{N}_{dec}{}^{LR}(i)$ denotes a level of a frequency band group i of the second spectrum SN2 of the noise of the audio output signal, wherein $i=0, \ldots, L^{LR}-1$, wherein $L^{LR}$ is the number of frequency band groups of the spectrum SBN of the background noise and of the second spectrum SN2 of the noise of the audio output signal OS. By these features the scaling factors SF may be computed in an easy manner.

According to an embodiment of the invention the comfort noise spectrum generator 7*b* is configured to compute the spectrum SCN of the comfort noise CN based on the scaling factors SF and based on the first spectrum SN1 of the noise of the audio output signal OS as provided by the noise estimation device 5. By these features the comfort noise spectrum SCN may be computed in such way that it has the spectral resolution of the first spectrum SN1 of the noise of the audio output signal OS.

According to an embodiment of the invention the comfort noise spectrum generator 7*b* is configured to compute the spectrum SCN of the comfort noise CN according to the formula $\hat{N}^{FR}(k)=\hat{S}^{LR}(i)\cdot\hat{N}_{dec}^{HR}(k)$, wherein $\hat{N}^{FR}(k)$ denotes a level of a frequency band k of the spectrum SCN of the comfort noise CN, wherein $\hat{S}^{LR}(i)$ denotes a scaling factor SF of a frequency band group i of the spectrum SBN of the background noise and of the second spectrum SN2 of the noise of the audio output signal OS, wherein $\hat{N}_{dec}^{HR}(k)$ denotes a level of a frequency band k of the first spectrum SN1 of the noise of the audio output signal OS, wherein $k=b^{LR}(i), \ldots, b^{LR}(i+1)-1$, wherein $b^{LR}(i)$ is a first frequency band of one of the frequency band groups, in $i=0, \ldots, L^{LR}-1$, wherein $L^{LR}$ is the number of frequency band groups of the spectrum SBN of the background noise and of the second spectrum SN2 of the noise of the audio output signal. By these features the spectrum SCN of the comfort noise CN may be computed at a high-resolution in an easy way.

According to an embodiment of the invention the resolution converter 6 comprises a first converter stage 11 configured to establish a third spectrum SN3 of the noise of the audio output signal OS based on the first spectrum SN1 of the noise of the audio output signal OS, wherein the spectral resolution of the third spectrum SN3 of the noise of the audio output signal OS is same or higher as the spectral resolution of the first spectrum SN1 of the noise of the audio output signal OS, and wherein the resolution converter 6 comprises a second converter stage 12 configured to establish the second spectrum SN2 of the noise of the audio output signal OS.

According to an embodiment of the invention the comfort noise spectrum generator 7*b* is configured to compute the spectrum SCN of the comfort noise CN based on the scaling factors SF and based on the third spectrum SN3 of the noise of the audio output signal OS as provided by the first converter stage 11 of the resolution converter 6. By these features a comfort noise spectrum SCN may be obtained which has a higher spectral resolution then the background noise spectrum SBN provided by the silence insertion descriptor decoder 3.

According to an embodiment of the invention the comfort noise spectrum generator 7*b* is configured to compute the spectrum SCN of the comfort noise according to the formula $\hat{N}^{FR}(k)=\hat{S}^{LR}(i)\cdot\hat{N}_{dec}^{FR}(k)$, wherein $\hat{N}^{FR}(k)$ denotes a level of a frequency band k of the spectrum SCN of the comfort noise CN, wherein $\hat{S}^{LR}(i)$ denotes a scaling factor SF of a frequency band group i of the spectrum SCN of the background noise and of the second spectrum SN2 of the noise of the audio output signal OS, wherein $\hat{N}_{dec}^{FR}(k)$ denotes a level of a frequency band k of the third spectrum SN3 of the noise of the audio output signal OS, wherein $k=b^{LR}(i), \ldots, b^{LR}(i+1)-1$, wherein $b^{LR}(i)$ is a first frequency band of a frequency band group, wherein $i=0, \ldots, L^{LR}-1$, wherein $L^{LR}$ is the number of frequency band groups of the spectrum SBN of the background noise and of the second spectrum SN2 of the noise of the audio output signal OS. By these features the spectrum SCN is of the comfort noise may be computed at the high-resolution in an easy way.

According to an embodiment of the invention the comfort noise generator 8 comprises a first fast Fourier converter 15 configured to adjust levels of frequency bands of the comfort noise CN in a fast Fourier transformation domain and a second fast Fourier converter 16 to produce at least a part of the comfort noise CN based on an output of the first fast Fourier converter 15. By these features the comfort noise can be produced in an easy way.

According to an embodiment of the invention the decoding device 2 comprises a core decoder 17 configured to produce the audio output signal OS during the active phase. By these features a simple structure of the decoder may be achieved which is suitable for narrowband (NB) and wideband (WB) applications.

According to the embodiment of the invention the audio decoder 1 comprises a header reading device 18, which is configured to discriminate between active phases and inactive phase. The header reading device 18 is further configured to switch a switch device 19 in such way that the bitstream BS during active phases is fed to the core decoder 17 and that the silence insertion descriptor frames during the inactive phases are fed to the silence insertion descriptor decoder 3. Additionally, an inactive phase flag is transmitted to the background noise generator 8 so that the generation of the comfort noise CN may be triggered.

Figure 2:
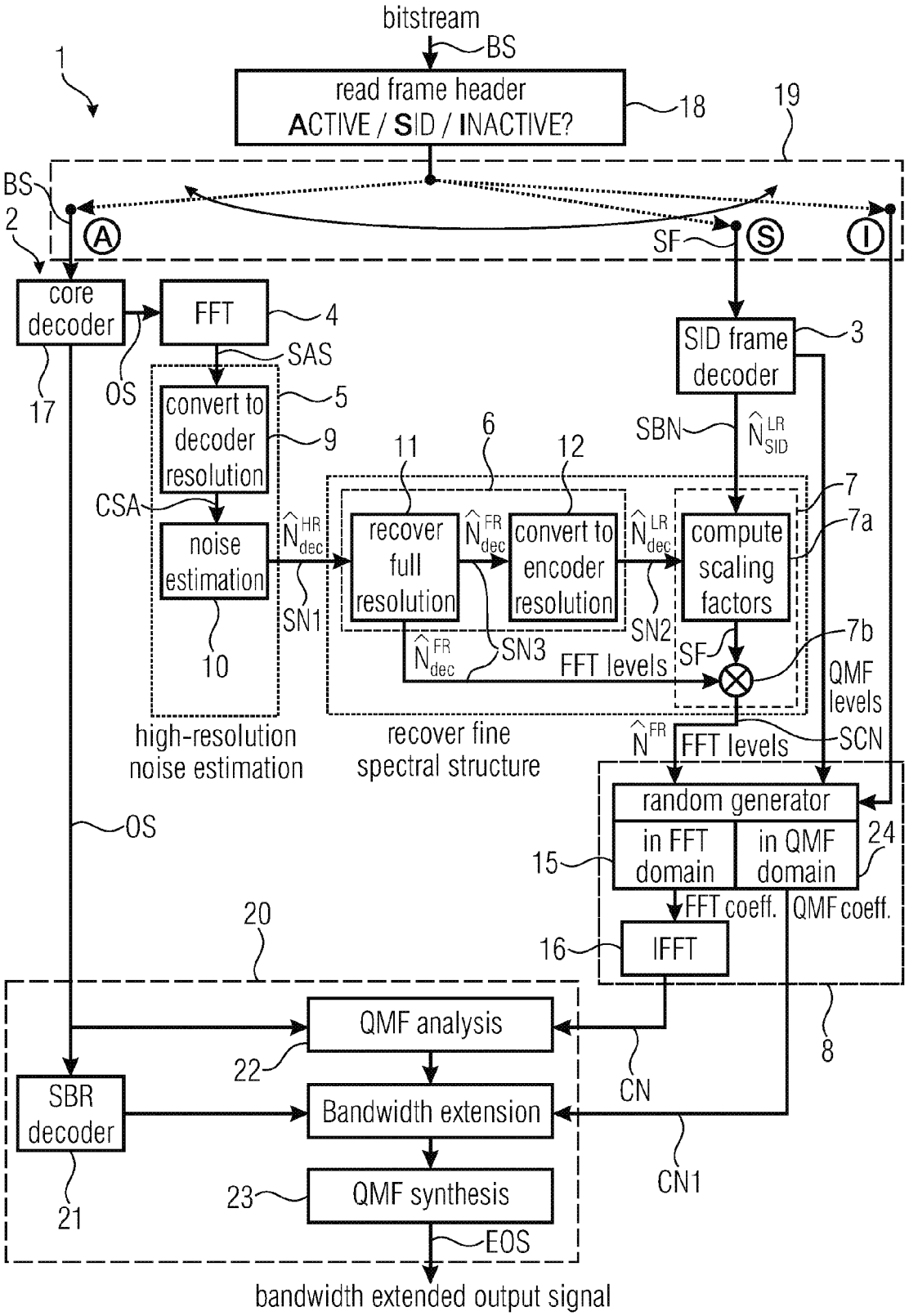
FIG. 2 illustrates a second embodiment of a decoder according to the invention.

FIG. 2 illustrates a second embodiment of an audio decoder 1 according to the invention. The decoder 1 depicted in FIG. 2 is based on the decoder 1 of FIG. 1. In the following only the differences will be explained. The audio decoder 1 of a second embodiment of the invention comprises a bandwidth extension module 20 to which the output signal of the core decoder 17 is fed. The bandwidth extension module 20 is configured to produce a bandwidth extended output signal EOS based on the audio output signal OS. By these features a simple structure of the decoder 1 may be achieved which is suitable for super wideband (SWB) applications.

According to an embodiment of the invention the comfort noise CN as provided by the fast Fourier converter 16 is fed to the bandwidth extension module 20. By this feature the comfort noise CN as provided by the fast Fourier converter 16 may be transformed into a comfort noise CN with a higher bandwidth.

According to an embodiment of the invention the comfort noise generator 8 comprises a quadrature mirror filter adjuster device 24 configured to adjust levels of frequency bands of the comfort noise CN in a quadrature mirror filter domain, wherein an output of the quadrature mirror filter synthesizer 24 is fed to the bandwidth extension module 20 as an additional comfort noise CN'. QMF levels contained in the silence insertion descriptor frames SI may be fed to the quadrature mirror filter synthesizer device 24. By these features noise information transmitted by the silence insertion descriptor frames SI related to noise frequencies above the bandwidth of the core decoder 17 may be used to further improve the comfort noise CN.

According to an embodiment of the invention the bandwidth extension module 20 comprises a spectral band replication decoder 21, a quadrature mirror filter analyzer 22, and/or a quadrature mirror filter synthesizer 23.

Figure 3:
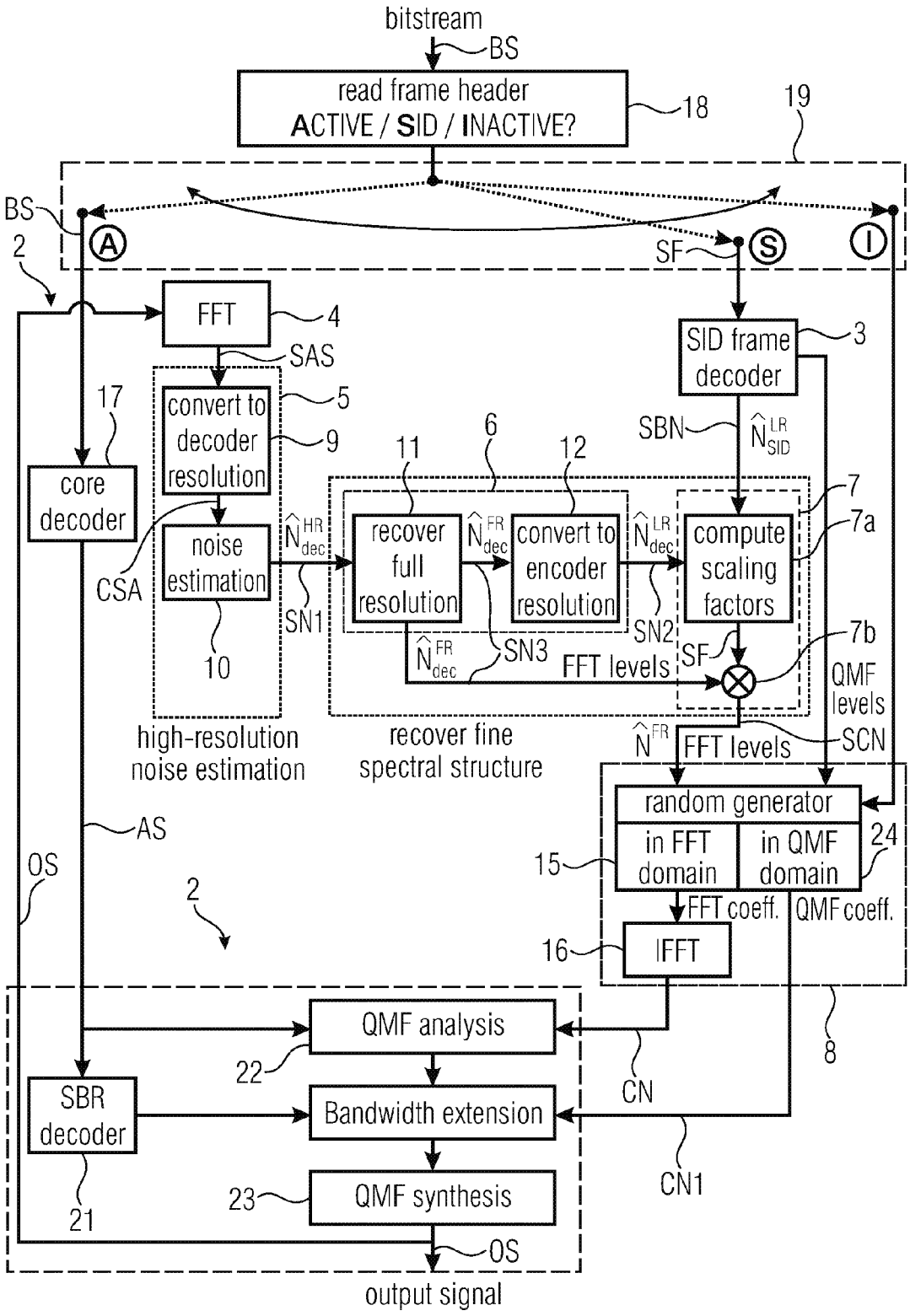
FIG. 3 illustrates a third embodiment of a decoder according to the invention.

FIG. 3 illustrates a third embodiment of a decoder 1 according to the invention. The decoder 1 of FIG. 3 is based on the decoder 1 of FIG. 2. The following only the differences to be discussed.

According to an embodiment of the invention the decoding device 2 comprises a core decoder 17 configured to produce an audio signal AS and a bandwidth extension module 20 configured to produce the audio output signal OS based on the audio signal AS as provided by the core decoder 17. By these features a simple structure of the decoder may be achieved which is suitable for super wideband (SWB) applications.

In principle the bandwidth extension module 20 of FIG. 3 is the same as the bandwidth extension module 20 of FIG. 2. However, in the third embodiment of the audio decoder 1 according to the invention the bandwidth extension module 20 is used to produce the audio output signal OS, which is fed to the spectral converter 4. By these features the entire bandwidth can be used for producing comfort noise.

Regarding the three embodiments of the audio decoder according to the invention it may be added: At the decoder side, a random generator 8 may be applied to excite each individual spectral band in the FFT domain, as well as in the QMF domain for SWB modes. The amplitude of the random sequences should be individually computed in each band such that the spectrum of the generated comfort noise CN resembles the spectrum of the actual background noise present in the bitstream.

The high-resolution noise estimates obtained at the decoder 1 capture information about the fine spectral structure of the background noise. However, these estimates cannot be adapted during inactive phases since the noise estimation is carried out on the decoded signal OS. In contrast, the SID frames SI deliver new information about the spectral envelope at regular intervals during inactive phases. The present decoder 1 combines these two sources of information in an effort to reproduce the fine spectral structure captured from the background noise present during active phases, while updating only the spectral envelope of the comfort noise CN during inactive parts with the help of the SID information.

To achieve this goal, an additional noise estimator 5 is used in the decoder 1, as shown in FIGS. 1 to 3. Hence, noise estimation is carried out at both sides of the transmission system, but applying a higher spectral resolution at the decoder 1 than at the encoder 100. One way to obtain a high spectral resolution at the decoder 1 is to simply consider each spectral band individually (full resolution) instead of grouping them via averaging like in the encoder 100.

Alternatively, a trade-off between spectral resolution and computational complexity can be obtained by carrying out the spectral grouping also in the decoder 1 but using an increased number of spectral groups compared to the encoder 100, yielding thereby a finer quantization of the frequency axis in the decoder.

Note that the decoder-side noise estimation operates on the decoded signal OS. In a DTX-based system, it should be therefore capable of operating during active phases only, i.e., necessarily on clean speech or noisy speech contents (in contrast to noise only).

The high-resolution (HR) noise power spectrum $\hat{N}_{dec}^{HR}$ computed at the decoder may be first interpolated (e.g., using linear interpolation) to provide a full-resolution (FR) power spectrum $\hat{N}_{dec}^{FR}$. It may then be converted to a low-resolution (LR) power spectrum $\hat{N}_{dec}^{LR}$ by spectral grouping (i.e., averaging) just as done in the encoder. The power spectrum $\hat{N}_{dec}^{LR}$ exhibits therefore the same spectral resolution as the noise levels $\hat{N}_{SID}^{LR}$ gained from the SID frames SI. Comparing the low-resolution noise spectra $\hat{N}_{dec}^{LR}$ and $\hat{N}_{SID}^{LR}$, the full-resolution noise spectrum $\hat{N}_{dec}^{FR}$ can be finally scaled to yield a full-resolution power spectrum as follows:

$$\hat{N}^{FR}(k) = \frac{\hat{N}_{SID}^{LR}(i)}{\hat{N}_{dec}^{LR}(i)} \cdot \hat{N}_{dec}^{FR}(k)$$

$$k = b^{LR}(i), \ldots, b^{LR}(i+1) - 1,$$

$$i = 0, \ldots, L^{LR} - 1,$$

where $L^{LR}$ is the number of spectral groups used by the low-resolution noise estimation in the encoder, and $b^{LR}(i)$ denotes the first spectral band of the ith spectral group, $i=0, \ldots, L^{LR}-1$. The full-resolution noise power spectrum $\hat{N}^{FR}(k)$ can finally be used to accurately adjust the level of comfort noise generated in each individual FFT or QMF band (the latter for SWB modes only).

In FIGS. 1 and 2, the above mechanism is applied to the FFT coefficients only. Hence, for SWB systems, it is not applied in the QMF bands capturing the high-frequency content left over by the core. Since these frequencies are perceptually less relevant, reproducing the smooth spectral envelope of the noise for these frequencies is sufficient in general.

To adjust the level of comfort noise applied in the QMF domain for frequencies which are above the core bandwidth in SWB modes, the system relies solely on the information transmitted by the SID frames. The SBR module is thus bypassed when the VAD triggers a CNG frame. In WB modes, the CNG module does not take the QMF bands into account since blind bandwidth extension is applied to recover the desired bandwidth.

Nevertheless, the scheme can be easily extended to cover the entire bandwidth by applying the decoder-side noise estimator at the output of the bandwidth extension module instead of applying it at the output of the core decoder. This extension as shown in FIG. 3 causes an increase in computational complexity since the high frequencies captured by the QMF filterbank have to be considered as well.

Figure 4:
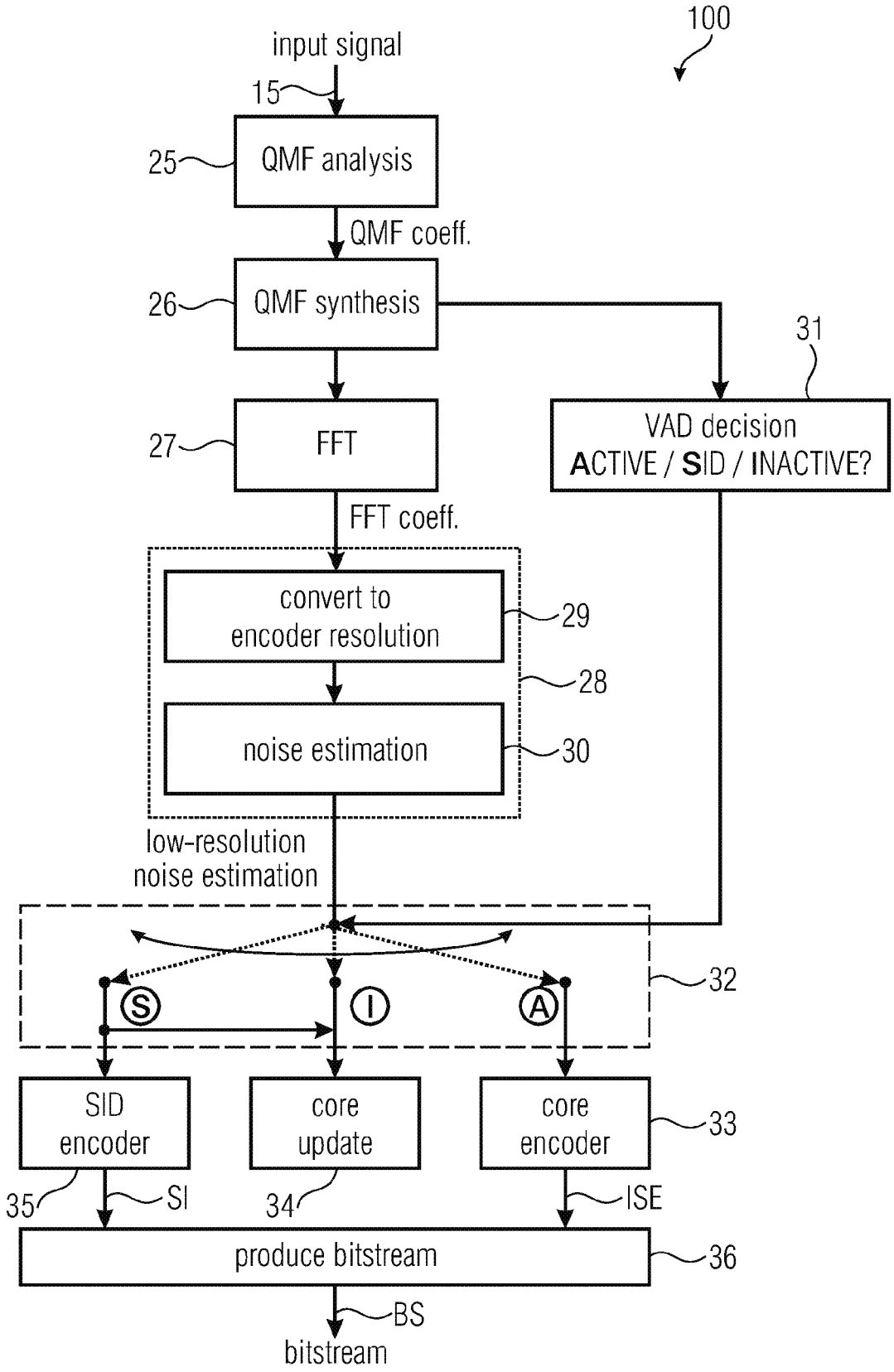
FIG. 4 illustrates a first embodiment of an encoder suitable for an inventive system.

FIG. 4 illustrates a first embodiment of an encoder 100 suitable for an inventive system. The input audio signal IS is fed to a first spectral converter 25 configured to transfer that time domain signal IS into a frequency domain. The first spectral converter 25 may be a quadrature mirror filter analyzer. The output of the first spectral converter 25 is fed to a second spectral converter 26 which is configured to transfer the output of the first spectral converter 25 to a domain. The second spectral converter 26 may be a quadrature mirror filter synthesizer. The output of the second spectral converter 26 is fed to a third spectral converter 27 which may be a fast Fourier transforming device. The output of the third spectral converter 27 is fed to a noise estimator device 28 which consists of a convert device 29 and a noise estimator 30.

Further, the encoder 100 comprises a signal activity detector 31 which is configured to switch the switch device 32 in such way that during active phases input signal is fed to a core encoder 33 and that in SID frames during inactive phases a noise estimation created by the noise estimating device 28 is fed to a silence insertion descriptor encoder 35. Further, in inactive phases an inactivity flag is fed to a core updater 34.

The encoder 100 further comprises a bitstream producer 36 which receives silence insertion descriptor frames SI from the silence insertion descriptor encoder 35 and an encoded input signal ISE from the core encoder 33 in order to produce the bitstream BS therefrom.

Figure 5:
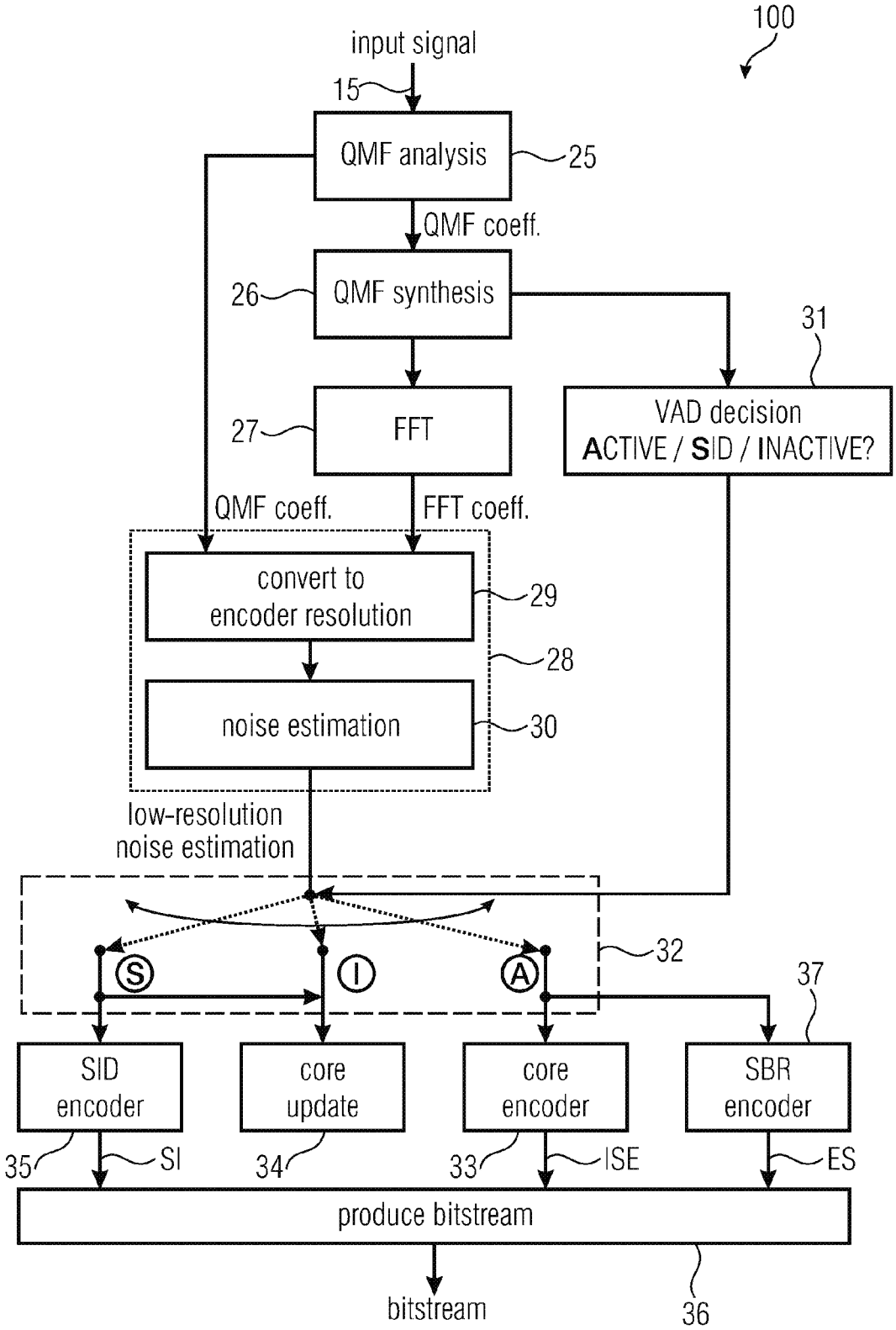
FIG. 5 illustrates a second embodiment of an encoder suitable for an inventive system.

FIG. 5 illustrates a second embodiment of an encoder 100 suitable for an inventive system which is based on the encoder 100 of first embodiment. The additional features of a second embodiment will briefly be explained in the following. The output of the first converter 25 is also fed to the noise estimator device 28. Further, during active phases, a spectral band replication encoder 37 produces an enhancement signal ES which contains information about higher frequencies in the input audio signal IS. That enhancement signal 37 is also transferred to the bitstream producer 36 so as to embed that enhancement signal ES into the bitstream BS.

Regarding the encoders shown in FIGS. 4 and 5 following information may be added: In case the VAD triggers a CNG phase, SID frames containing information about the input background noise are transmitted. This should allow the decoder to generate an artificial noise resembling the actual background noise in terms of spectro-temporal characteristics. To this aim, a noise estimator 28 is applied at the encoder side to track the spectral shape of the background noise present in the input signal IS, as shown in FIGS. 4 and 5

In principle, noise estimation can be applied with any spectro-temporal analysis tool decomposing a time-domain signal into multiple spectral bands, as long as it offers sufficient spectral resolution. In the present system, a QMF filterbank is used as a resampling tool to downsample the input signal to the core sampling rate. It exhibits a significantly lower spectral resolution than the FFT which is applied to the downsampled core signal.

Since the core encoder 33 already covers the entire NB bandwidth and since WB modes rely on blind bandwidth extension, the frequencies above the core bandwidth are irrelevant and can be simply discarded for NB and WB systems. In SWB modes, in contrast, those frequencies are captured by the upper QMF bands and need to be taken into account explicitly.

The size of an SID frame SI is very limited in practice. Therefore, the number of parameters describing the background noise has to be kept as small as possible. To this aim, the noise estimation is not applied directly in the output of the spectral transforms. Instead, it is applied at a lower spectral resolution by averaging the input power spectrum among groups of bands, e.g., following the Bark scale. The averaging can be achieved either by arithmetic or geometric means. In the SWB case, the spectral grouping is carried out for the FFT and QMF domains separately, whereas the NB and WB modes rely on the FFT domain only.

Note that reducing the spectral resolution is also advantageous in terms of computational complexity since the noise estimation needs to be applied to only a small number of spectral groups instead of considering each spectral band individually.

The estimated noise levels (one for each spectral group) can be jointly encoded in SID frames using vector quantization techniques. In NB and WB modes, only the FFT domain is exploited. In contrast, for SWB modes, the encoding of SID frames can be performed for both FFT and QMF domains jointly using vector quantization, i.e., resorting to a single codebook covering both domains.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

Depending on certain implementation requirements, embodiments of the invention can be implemented in hardware or in software. The implementation can be performed using a non-transitory storage medium such as a digital storage medium, for example a floppy disc, a DVD, a Blu-Ray, a CD, a ROM, a PROM, and EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may, for example, be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive method is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the invention method is, therefore, a data stream or a sequence of signals representing the computer program for performing one of the methods described herein. The data stream or the sequence of signals may, for example, be configured to be transferred via a data communication connection, for example, via the internet.

A further embodiment comprises a processing means, for example, a computer or a programmable logic device, configured to, or adapted to, perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example, a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCE SIGNS

1 audio decoder
2 decoding device
3 silence insertion descriptor decoder
4 spectral converter
5 noise estimator device
6 resolution converter
7 comfort noise spectrum estimation device
7*a* scaling factor computing device
7*b* comfort noise spectrum generator
8 comfort noise generator
9 converter device
10 noise estimator
11 first converter stage
12 second converter stage
15 first fast Fourier converter
16 second fast Fourier analyzer
17 core decoder
18 header reading device
19 switch device
20 bandwidth extension module
21 spectral band replication decoder
22 quadrature mirror filter analyzer
23 quadrature mirror filter synthesizer
24 quadrature mirror filter adjuster device
25 first spectral converter
26 second spectral converter
27 third spectral converter
28 noise estimator device
29 converter device
30 noise estimator
31 signal activity detector
32 switch device
33 core encoder
34 core updater
35 silence insertion descriptor encoder
36 bitstream producer
37 spectral band replication encoder
100 encoder
BS bitstream
OS audio output signal
SI silence insertion descriptor frame
SBN spectrum of the background noise
SAS spectrum of the audio signal
SN1 first spectrum of the noise of the audio signal
SN2 second spectrum of the noise of the audio signal
SF scaling factors
SCN spectrum of the comfort noise
CN comfort noise
AS output signal
CSA converted spectrum of the audio signal
SN3 third spectrum of the noise of the audio signal
EOS bandwidth extended output signal
IS input audio signal
ISE encoded input signal
ES enhancement signal

The invention claimed is:

1. Audio decoder for decoding a bitstream so as to produce therefrom an audio output signal, the bitstream comprising at least an active phase followed by at least an inactive phase, wherein the bitstream has encoded therein at least a silence insertion descriptor frame which describes a spectrum of a background noise, the audio decoder comprising:

a silence insertion descriptor decoder configured to decode the silence insertion descriptor frame so as to reconstruct the spectrum of the background noise;

a decoding device configured to reconstruct the audio output signal from the bitstream during the active phase;

a spectral converter configured to determine a spectrum of the audio output signal;

a noise estimator device configured to determine a first spectrum of noise of the audio output signal based on the spectrum of the audio output signal provided by the spectral converter, wherein the first spectrum of the noise of the audio output signal comprises a higher spectral resolution than the spectrum of the background noise;

a resolution converter configured to establish a second spectrum of the noise of the audio output signal based on the first spectrum of the noise of the audio output signal, wherein the second spectrum of the noise of the audio output signal comprises a same spectral resolution as the spectrum of the background noise;

a comfort noise spectrum estimation device comprising a scaling factor computing device configured to compute scaling factors for a spectrum for a comfort noise based on the spectrum of the background noise as provided by the silence insertion descriptor decoder and based on the second spectrum of the noise of the audio output signal as provided by the resolution converter and comprising a comfort noise spectrum generator configured to compute the spectrum for a comfort noise based on the scaling factors; and a comfort noise generator configured to produce the comfort noise during the inactive phase based on the spectrum for the comfort noise.

2. Audio decoder according to claim 1, wherein the spectral converter comprises a fast Fourier transformation device.

3. Audio decoder according to claim 1, wherein the noise estimator device comprises a converter device configured to convert the spectrum of the audio output signal into a converted spectrum of the audio output signal which comprises same or lower spectral resolution than the spectrum of the output audio signal and a higher spectral resolution than the spectrum of the background noise.

4. Audio decoder according to claim 3, wherein the noise estimator device comprises a noise estimator configured to determine the first spectrum of the noise of the audio output signal based on the converted spectrum of the audio output signal provided by the converter device.

5. Audio decoder according to claim 1, wherein the scaling factor computing device is configured to compute the scaling factors according to the formula $$\hat{S}^{LR}(i) = \frac{\hat{N}_{SID}^{LR}(i)}{\hat{N}_{dec}^{LR}(i)},$$

wherein $\hat{S}^{FR}(i)$ denotes a scaling factor for a frequency band group i of the comfort noise, wherein $\hat{N}_{SID}^{LR}(i)$ denotes a level of a frequency band group i of the spectrum of the background noise, wherein $\hat{N}_{dec}^{LR}(i)$ denotes a level of a frequency band group i of the second spectrum of the noise of the audio output signal, wherein $i=0, \ldots, L^{LR}-1$, wherein $L^{LR}$ is the number of frequency band groups of the spectrum of the background noise and of the second spectrum of the noise of the audio output signal.

6. Audio decoder according to claim 1, wherein the comfort noise spectrum generator is configured to compute the spectrum of the comfort noise based on the scaling factors and based on the first spectrum of the noise of the audio output signal as provided by the noise estimation device.

7. Audio decoder according to claim 1, wherein the comfort noise spectrum generator is configured to compute the spectrum of the comfort noise according to the formula $\hat{N}^{FR}(k)=\hat{S}^{LR}(i)\cdot\hat{N}_{dec}^{HR}(k)$, wherein $\hat{N}^{FR}(k)$ denotes a level of a frequency band k of the spectrum of the comfort noise, wherein $\hat{S}^{LR}(i)$ denotes a scaling factor of a frequency band group i of the spectrum of the background noise and of the second spectrum of the noise of the audio output signal, wherein $\hat{N}_{dec}^{HR}(k)$ denotes a level of a frequency band k of the first spectrum of the noise of the audio output signal, wherein $k=b^{LR}(i), \ldots, b^{LR}(i+1)-1$, wherein $b^{LR}(i)$ is a first frequency band of one of the frequency band groups, wherein $i=0, \ldots, L^{LR}-1$, wherein $L^{LR}$ is the number of frequency band groups of the spectrum of the background noise and of the second spectrum of the noise of the audio output signal.

8. Audio decoder according to claim 1, wherein the resolution converter comprises a first converter stage configured to establish a third spectrum of the noise of the audio output signal based on the first spectrum of the noise of the audio output signal, wherein the spectral resolution of the third spectrum of the noise of the audio output signal is same or higher as the spectral resolution of the first spectrum of the noise of the audio output signal, and wherein the resolution converter comprises a second converter stage configured to establish the second spectrum of the noise of the audio output signal.

9. Audio decoder according to claim 8, wherein the comfort noise spectrum generator is configured to compute the spectrum of the comfort noise based on the scaling factors and based on the third spectrum of the noise of the audio output signal as provided by the first converter stage of the resolution converter.

10. Audio decoder according to claim 8, wherein the comfort noise spectrum generator is configured to compute the spectrum of the comfort noise according to the formula $\hat{N}^{FR}(k)=\hat{S}^{LR}(i)\cdot\hat{N}_{dec}^{FR}(k)$, wherein $\hat{N}^{FR}(k)$ denotes a level of a frequency band k of the spectrum of the comfort noise, wherein $\hat{S}^{LR}(i)$ denotes a scaling factor of a frequency band group i of the spectrum of the background noise and of the second spectrum of the noise of the audio output signal, wherein $\hat{N}_{dec}^{FR}(k)$ denotes a level of a frequency band k of the third spectrum of the noise of the audio output signal, wherein $k=b^{LR}(i), \ldots, b^{LR}(i+1)-1$, wherein $b^{LR}(i)$ is a first frequency band of a frequency band group, in $i=0, \ldots, L^{LR}-1$, wherein $L^{LR}$ is the number of frequency band groups of the spectrum of the background noise and of the second spectrum of the noise of the audio output signal.

11. Audio decoder according to claim 1, wherein the comfort noise generator comprises a first fast Fourier converter configured to adjust levels of frequency bands of the comfort noise in a fast Fourier transformation domain and a second fast Fourier converter to produce at least a part of the comfort noise based on an output of the first fast Fourier converter.

12. Audio decoder according to claim 1, wherein the decoding device comprises a core decoder configured to produce the audio output signal during the active phase.

13. Audio decoder according to claim 1, wherein the decoding device comprises a core decoder configured to produce an audio signal and a bandwidth extension module configured to produce the audio output signal based on the audio signal as provided by the core decoder.

14. Audio decoder according to claim 13, wherein the bandwidth extension module comprises a spectral band replication decoder, a quadrature mirror filter analyzer, and/or a quadrature mirror filter synthesizer.

15. Audio decoder according to claim 13, wherein the comfort noise as provided by the comfort noise generator is fed to the bandwidth extension module.

16. Audio decoder according to claim 13, wherein the comfort noise generator comprises a quadrature mirror filter adjuster device configured to adjust levels of frequency bands of the comfort noise in a quadrature mirror filter domain, wherein an output of the quadrature mirror filter synthesizer is fed to the bandwidth extension module.

17. A system comprising a decoder and an encoder, wherein the decoder comprises the audio decoder of claim 1.

18. A method of decoding an audio bitstream so as to produce therefrom an audio output signal, the bitstream comprising at least an active phase followed by at least an inactive phase, wherein the bitstream has encoded therein at least a silence insertion descriptor frame which describes a spectrum of a background noise, the method comprising:

decoding the silence insertion descriptor frame so as to reconstruct the spectrum of the background noise;

reconstructing the audio output signal from the bitstream during the active phase;

determining a spectrum of the audio output signal;

determining a first spectrum of noise of the audio output signal based on the spectrum of the audio output signal, wherein the first spectrum of the noise of the audio output signal comprises a higher spectral resolution than the spectrum of the background noise;

establishing a second spectrum of the noise of the audio output signal based on the first spectrum of the noise of the audio output signal, wherein the second spectrum of the noise of the audio output signal comprises a same spectral resolution as the spectrum of the background noise;

computing scaling factors for a spectrum for a comfort noise based on the spectrum of the background noise and based on the second spectrum of the noise of the audio output signal;

computing the spectrum for the comfort noise based on the scaling factors; and producing the comfort noise during the inactive phase based on the spectrum for the comfort noise.

19. A non-transitory storage medium having stored thereon a computer program for performing, when running on a computer or a processor, the method of claim 18.

* * * * *